US011732398B2

(12) United States Patent
Heo et al.

(10) Patent No.: US 11,732,398 B2
(45) Date of Patent: Aug. 22, 2023

(54) MULTIFUNCTIONAL STORAGE SYSTEM INCLUDING HEAT PUMP UNIT HAVING MOISTURE SUPPLY UNIT AND METHOD OF PREHEATING USING THE SAME

(71) Applicant: COWAY Co., Ltd., Gongju-si (KR)

(72) Inventors: Sung Hwan Heo, Seoul (KR); Jin Min Kim, Seoul (KR); Tae Kyung Kang, Seoul (KR); Kyung Su Lee, Seoul (KR); Il Song Park, Seoul (KR); Byung Soo Yun, Seoul (KR)

(73) Assignee: COWAY Co., Ltd., Gongju-si (KR)

( * ) Notice: Subject to any disclaimer, the term of this patent is extended or adjusted under 35 U.S.C. 154(b) by 308 days.

(21) Appl. No.: 16/771,081

(22) PCT Filed: Dec. 19, 2018

(86) PCT No.: PCT/KR2018/016208
§ 371 (c)(1),
(2) Date: Jun. 9, 2020

(87) PCT Pub. No.: WO2019/124958
PCT Pub. Date: Jun. 27, 2019

(65) Prior Publication Data

US 2021/0198837 A1 Jul. 1, 2021

(30) Foreign Application Priority Data

Dec. 22, 2017 (KR) ..... 10-2017-0178615

(51) Int. Cl.
*D06F 58/24* (2006.01)
*F25B 30/02* (2006.01)
(Continued)

(52) U.S. Cl.
CPC ..... *D06F 58/10* (2013.01); *D06F 58/24* (2013.01); *F25B 30/02* (2013.01); *D06F 58/20* (2013.01);
(Continued)

(58) Field of Classification Search
CPC ..... F24F 8/00; F24F 2221/18; D06F 58/10; D06F 58/24; D06F 58/38; D06F 58/20;
(Continued)

(56) References Cited

U.S. PATENT DOCUMENTS 10,041,203 B2 8/2018 Ahn et al.
2004/0117919 A1* 6/2004 Conrad ..... D06L 1/08 8/137
(Continued)

FOREIGN PATENT DOCUMENTS

JP 2015-39597 A 3/2015
KR 10-0782377 B1 12/2007
(Continued)

OTHER PUBLICATIONS

International Search Report dated Apr. 8, 2019 in PCT/KR2018/016208 filed on Dec. 19, 2018, 2 pages.

*Primary Examiner* — Benjamin L Osterhout
(74) *Attorney, Agent, or Firm* — Oblon, McClelland, Maier & Neustadt, L.L.P.

(57) ABSTRACT

Disclosed is a multifunctional storage system including a machine chamber and a compartment, in which clothes are received, the multifunctional storage system including: a heat pump unit located in the machine chamber and including an evaporator, a condenser, a compressor, and a pressure controller; a moisture supply unit coupled to the heat pump unit and including a humidification filter; and a fan unit configured to circulate air in the machine chamber from the evaporator toward the condenser, wherein the moisture
(Continued)

supply unit is coupled to a front end of the evaporator with reference to a circulation direction of the air, and wherein moisture is supplied to the humidification filter according to a preset condition, and loads of the evaporator and the condenser are increased as the moisture is supplied to the air when the air passes through the humidification filter.

15 Claims, 9 Drawing Sheets

(51) Int. Cl.

| | |
|---|---|
| ***D06F 58/20*** | (2006.01) |
| ***D06F 58/10*** | (2006.01) |
| *D06F 103/44* | (2020.01) |
| *D06F 105/26* | (2020.01) |
| *D06F 105/12* | (2020.01) |
| *D06F 58/38* | (2020.01) |
| *D06F 103/50* | (2020.01) |
| *F24F 8/00* | (2021.01) |
| *D06F 73/02* | (2006.01) |
| *D06F 58/36* | (2020.01) |

(52) U.S. Cl.
CPC ..... *D06F 58/206* (2013.01); *D06F 58/36* (2020.02); *D06F 58/38* (2020.02); *D06F 73/02* (2013.01); *D06F 2103/44* (2020.02); *D06F 2103/50* (2020.02); *D06F 2105/12* (2020.02); *D06F 2105/26* (2020.02); *F24F 8/00* (2021.01); *F24F 2221/18* (2013.01); *F25B 2600/11* (2013.01); *F25B 2600/13* (2013.01); *F25B 2700/02* (2013.01)

(58) Field of Classification Search
CPC .... D06F 58/206; D06F 2103/50; D06F 58/36; D06F 73/02; D06F 2105/02; D06F 2103/44; D06F 2105/26; F25B 30/02; F25B 2600/13; F25B 2700/02; F25B 2600/11
See application file for complete search history.

(56) References Cited

U.S. PATENT DOCUMENTS

| | | | | |
|---|---|---|---|---|
| 2005/0066538 | A1* | 3/2005 | Goldberg | D06F 34/26 34/218 |
| 2005/0115120 | A1* | 6/2005 | Cevik | D06F 73/02 38/14 |
| 2008/0235977 | A1* | 10/2008 | Kuwabara | D06F 58/206 134/105 |
| 2009/0151188 | A1* | 6/2009 | Moon | D06F 58/20 34/235 |
| 2009/0241606 | A1* | 10/2009 | Yoo | D06F 73/02 68/5 C |
| 2009/0248206 | A1* | 10/2009 | Yoo | D06F 58/50 700/275 |
| 2010/0018072 | A1* | 1/2010 | Kim | D06F 58/203 62/238.7 |
| 2011/0016928 | A1* | 1/2011 | Beihoff | D06F 58/203 68/19 |
| 2011/0016930 | A1* | 1/2011 | Moon | D06F 58/203 68/5 C |
| 2011/0035953 | A1* | 2/2011 | Kuhl | D06F 58/20 34/73 |
| 2011/0041355 | A1* | 2/2011 | Kuhl | D06F 58/206 34/86 |
| 2013/0117944 | A1* | 5/2013 | Moon | D06F 58/44 68/5 R |
| 2015/0197882 | A1 | 7/2015 | Ahn et al. | |

FOREIGN PATENT DOCUMENTS

| | | | |
|---|---|---|---|
| KR | 10-2008-0004028 | A | 1/2008 |
| KR | 10-2009-0100801 | A | 9/2009 |
| KR | 10-2015-0085728 | A | 7/2015 |
| KR | 10-2017-0006555 | A | 1/2017 |

* cited by examiner

MULTIFUNCTIONAL STORAGE SYSTEM INCLUDING HEAT PUMP UNIT HAVING MOISTURE SUPPLY UNIT AND METHOD OF PREHEATING USING THE SAME

TECHNICAL FIELD

The present disclosure relates to a multifunctional storage system including a heat pump having a moisture supply unit and a method of preheating the multifunctional storage system using the same, and more particularly to a technology of preheating a multifunctional storage by providing a moisture supply unit to increase the condensation loads of an evaporator and a condenser of a heat pump provided in a machine chamber.

BACKGROUND ART

Recently, an air pollution problem due to fine dust has been issued. Accordingly, devices, such as air cleaners related to air cleaning, have been spotlighted.

However, since an air cleaner, etc. can only purify the air in a closed interior space, it is difficult to remove all of the dust that may have been attached to clothes, etc. while staying outdoors.

Although dust has been physically removed by a method of beating the dust off the clothes outside, etc., it is difficult to use such a method these days because the contamination level of exterior air is often very serious.

Accordingly, recently, clothes managing devices for removing fine dust, etc. that may have been attached to the clothes that have been worn while staying outdoors are being developed and used.

Meanwhile, the clothes managing device includes a compartment, which receives clothes, and a machine chamber provided with devices for sterilizing, humidifying, or drying clothes in the compartment, and the machine chamber is provided with a heat pump module.

In relation to the heat pump module, while the air in the compartment circulates during a drying operation, the moisture in the air is condensed by an evaporator and is then removed, and the air is heated by a condenser and is supplied again to the compartment.

When the amount of the moisture is decreased during the drying operation, the load of the evaporator is decreased, and the temperature of the air that passes through the condenser is further decreased because the condensation load is decreased in the evaporator.

Consequently, there is a problem in that as the temperature of the existing air being heated is also decreased, the temperature of the air supplied to the compartment is also decreased, and as a result, the drying efficiency of the clothes received in the compartment significantly deteriorates.

Meanwhile, Korean Patent Application Publication No. 10-2008-0004028, which is a conventional technology, discloses a laundry treating apparatus.

In detail, the conventional technology discloses a laundry treating apparatus including: a cabinet provided with an interior space, which is separated from the outside and in which clothes are received, and in which the interior space optionally communicates with the outside though a door; a steam generator provided in the cabinet and configured to supply steam into the interior space; and a heated air supply device provided in the cabinet and configured to optionally supply heated air of a middle temperature equal to or higher than a room temperature and heated air of a high temperature into the interior space.

However, the conventional technology discloses only contents of supplying heated air into an interior space, in which clothes are received, but loads applied to an evaporator and a condenser are not considered at all.

Accordingly, there is a high need for the development of a technology which is capable of increasing the temperature of the air being supplied into the compartment by increasing loads applied to the evaporator and the condenser, thereby increasing the drying efficiency and the humidification efficiency of the clothes received in the compartment. (Patent Document 1) Korean Patent Application Publication No. 10-2008-0004028

DISCLOSURE

Technical Problem

The present disclosure has been made in an effort to solve the above-described problems.

In detail, the present disclosure proposes a structure of a multifunctional storage system which can increase the amount of moisture contained in the air that circulates through a machine chamber.

Additionally, the present disclosure proposes a structure and a method for preheating a multifunctional storage system, by which loads applied to an evaporator and a condenser are increased by increasing the amount of moisture contained in circulating air, and the efficiency of the multifunctional storage system is increased in a drying or humidification mode.

Technical Solution

To solve the above problems, an aspect of the present disclosure provides a multifunctional storage system 1000 including a machine chamber 100 and a compartment 200, in which clothes are received, the multifunctional storage system including: a heat pump unit 110 located in the machine chamber 100 and including an evaporator 112, a condenser 114, a compressor 116, and a pressure controller; a moisture supply unit 120 coupled to the heat pump unit 110 and including a humidification filter 122; and a fan unit 130 configured to circulate air in the machine chamber 100 from the evaporator 112 toward the condenser 114, wherein the moisture supply unit 120 is coupled to a front end of the evaporator 112 with reference to a circulation direction of the air, and wherein moisture is supplied to the humidification filter 122 according to a preset condition, and loads of the evaporator 112 and the condenser 114 are increased as the moisture is supplied to the air when the air passes through the humidification filter 122

Additionally, it is preferable that the moisture supply unit 120 further includes: a moisture supply vessel 124 provided below the humidification filter 122 and configured to store the water flowing out of the humidification filter 122; and a moisture supply pump 126 connected to the moisture supply vessel 124 and configured to pump up the water in the moisture supply vessel 124; and the humidification filter 122 is configured to allow the water stored in the moisture supply vessel 124 to be supplied thereto by the moisture supply pump 126.

Additionally, it is preferable that the moisture supply unit 120 further includes a humidification heater unit 128 connected to the moisture supply pump 126, configured to receive water from the moisture supply vessel 124, and configured to heat the temperature of the water to a preset temperature, and the moisture supply pump 126 is configured to supply the water heated to the preset temperature by the humidification heater unit 128 to the humidification filter 122.

Additionally, it is preferable that the multifunctional storage system 1000 further includes: a water supply tank 104 configured to store water and connected to the water supply pump 102, and the water supply pump 102 is operated to supply moisture to the humidification filter 122 when the level of water in the moisture supply vessel 124 of the moisture supply unit 120 is formed to be equal to or less than a preset value.

Additionally, it is preferable that the water supply tank 104 is connected to the humidification heater unit 128 and the water stored in the water supply tank 104 is heated while passing through the humidification heater unit 128 and is supplied to the humidification filter 122 when the water supply pump 102 is operated.

Additionally, it is preferable that a circuit unit 150 is electrically coupled to the compressor 116, the circuit unit 150 includes a current measuring unit 152 configured to measure the value of a current flowing through the compressor 116, and moisture is supplied to the humidification filter 122 when the value of the current measured by the current measuring unit 152 is a preset value or less, and the supply of moisture to the humidification filter 122 is stopped when the value of the current is greater than the preset value.

Additionally, it is preferable that the machine chamber 100 is located below the compartment 200, the first and second passage switching units 160 and 170 are provided between the machine chamber 100 and the compartment 200, the airs in the machine chamber 100 and the compartment 200 communicate with each other such that they circulate together when the fan unit 130 is operated in a state in which both the first and second passage switching units 160 and 170 are operated at a first location, and the communication between the airs in the machine chamber 100 and the compartment 200 is blocked in a state in which both the first and second passage switching units 160 and 170 are operated at a second location, and when the fan unit 130 is operated, exterior air is discharged again to the an exhaustion duct 190 of the machine chamber 100 after being sucked into the machine chamber 100.

Additionally, it is preferable that the machine chamber 100 further includes an air cleaning unit 180, and in a state in which both the first and second passage switching units 160 and 170 are operated at the second location, the exterior air is discharged to the discharge duct 190 of the machine chamber after passing through the air cleaning unit 180.

Additionally, it is preferable that in a state in which both the first and second passage switching units 160 and 170 are operated at the first location, the heat pump unit 110 is operated to preheat the machine chamber 100.

Additionally, it is preferable that in a state in which both the first and second passage switching units 160 and 170 are operated at the second location, the heat pump unit 110 is operated to preheat the machine chamber 100.

Additionally, it is preferable that the pressure controller is a capillary tube.

Additionally, it is preferable that the pressure controller is an expansion control valve.

Additionally, an aspect of the present disclosure provides a method of preheating the multifunctional storage system 1000 described above, the method including: (a) operating the heat pump unit 110 (S100); (b) measuring the value of a current flowing through the compressor 116 by the current measuring unit 152 provided in the circuit unit 150 (S110); (c) comparing the value of the current with a preset current value by the control unit 154 provided in the circuit unit 150 (S120); and (d) supplying moisture to the humidification filter 122 when the control unit 154 determines that the value of the current is the preset current value or less (S130).

Additionally, it is preferable that the multifunctional storage system further includes: before step (a) (S100), (a-0) operating both the first and second passage switching units 160 and 170 at a first location (S90).

Additionally, it is preferable that the multifunctional storage system further includes: before step (a) (S100), (a-1) operating both the first and second passage switching units 160 and 170 at a second location (S90).

Advantageous Effects

According to the present disclosure, since a humidification filter is provided at a front end of a heat pump unit, the moisture content of the air that passes through the heat pump can be increased, and accordingly, the present disclosure provides an effect capable of increasing the loads of an evaporator and a condenser that constitute the heat pump.

As such, since moisture is supplied by the humidification filter within a range not affecting the humidity in a compartment, the loads of the evaporator and the condenser can be increased, and ultimately, the temperature of the air that circulates through the compartment and the machine chamber can be increased by increasing the temperature of the air that passes through the heat pump.

Accordingly, the humidification efficiency and the drying efficiency of the clothes received in the compartment can be increased.

Further, since the value of a current flowing through a circuit unit coupled to a compressor that constitutes the heat pump can be measured and moisture can be supplied to the humidification filter according to the current value, the loads of the evaporator and the condenser can be constantly maintained at an increased value.

BEST MODE

Hereinafter, for a detailed description of a machine chamber and a compartment, drawings, in which a case of a multifunctional storage system is dismounted, will be referenced, a direction which an exhaustion duct and an intake duct face will be defined as "a front surface", those located above the compartment and the machine chamber will be premised, and the left side and the right side of the multifunctional storage system will be defined with reference to the premise.

Further, a description of a flow direction of a refrigerant flowing through a heat pump unit will be omitted.

1. Description of Configuration of Multifunctional Storage System

Hereinafter, a multifunctional storage system according to an embodiment of the present disclosure will be described with reference to FIGS. 1 to 6.

Figure 1:
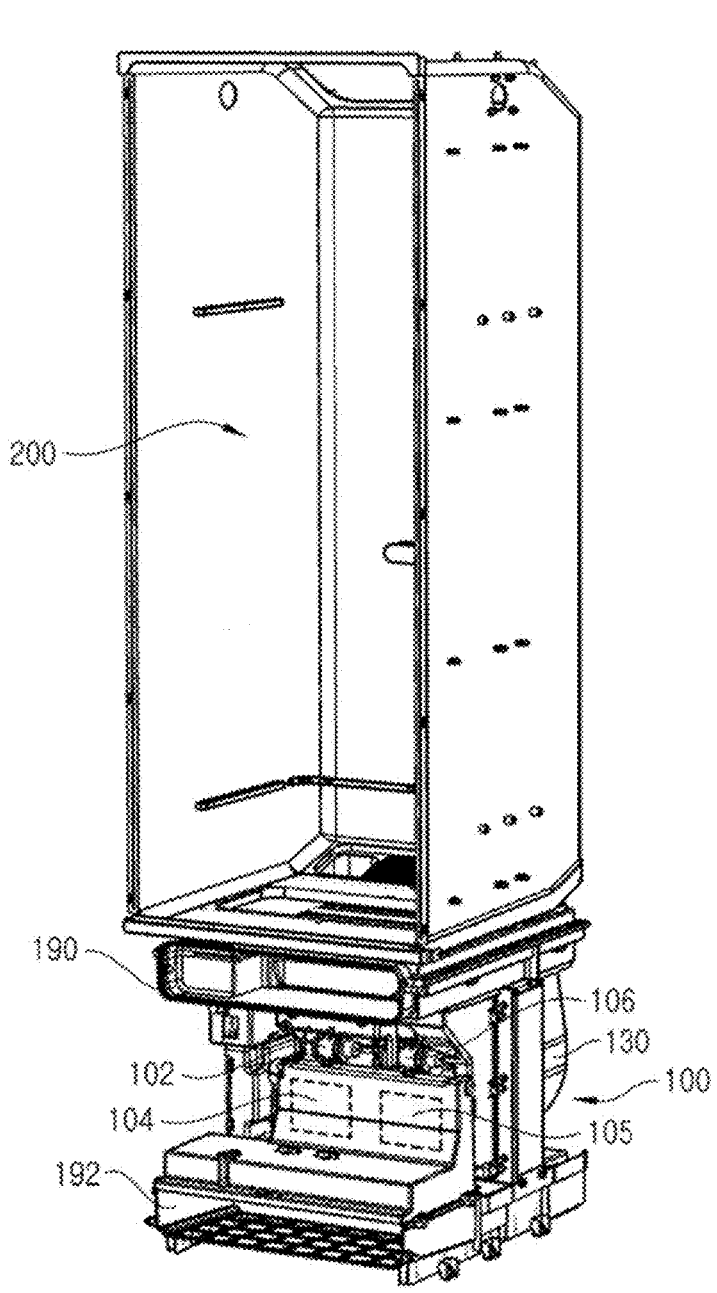
FIG. 1 is a perspective view of a multifunctional storage system according to the present disclosure in a state in which a case is dismounted.

FIG. 1 is a perspective view of a multifunctional storage system according to the present disclosure in a state in which a case is separated.

Referring to FIG. 1, the compartment 200 is located above the machine chamber 100, clothes are received in the compartment 200, and necessary means for drying, cleaning, and humidifying the clothes are provided in the machine chamber 100.

In particular, an exhaustion duct 190 configured to discharge air in the machine chamber 100 or the compartment 200 to the outside is formed above the front side of the machine chamber 100, and an intake duct 192 configured to suction exterior air into the machine chamber 100 is formed below the front side of the machine chamber 100.

Further, for circulation of air, a fan unit 130 is provided on the rear surface of the machine chamber 100.

Figure 2:
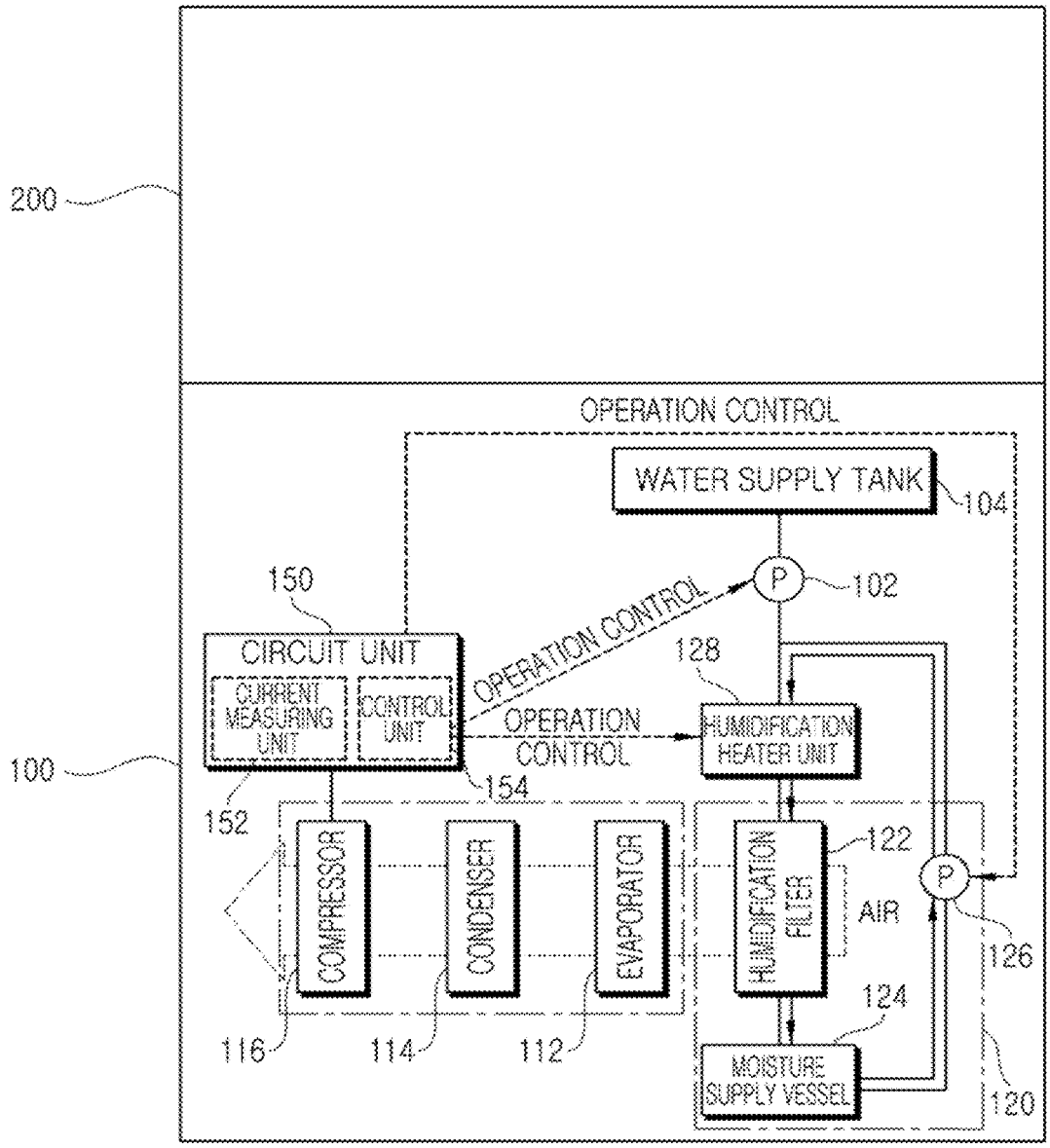
FIG. 2 is a schematic diagram of a machine chamber of the multifunctional storage system according to the present disclosure.
Figure 3:
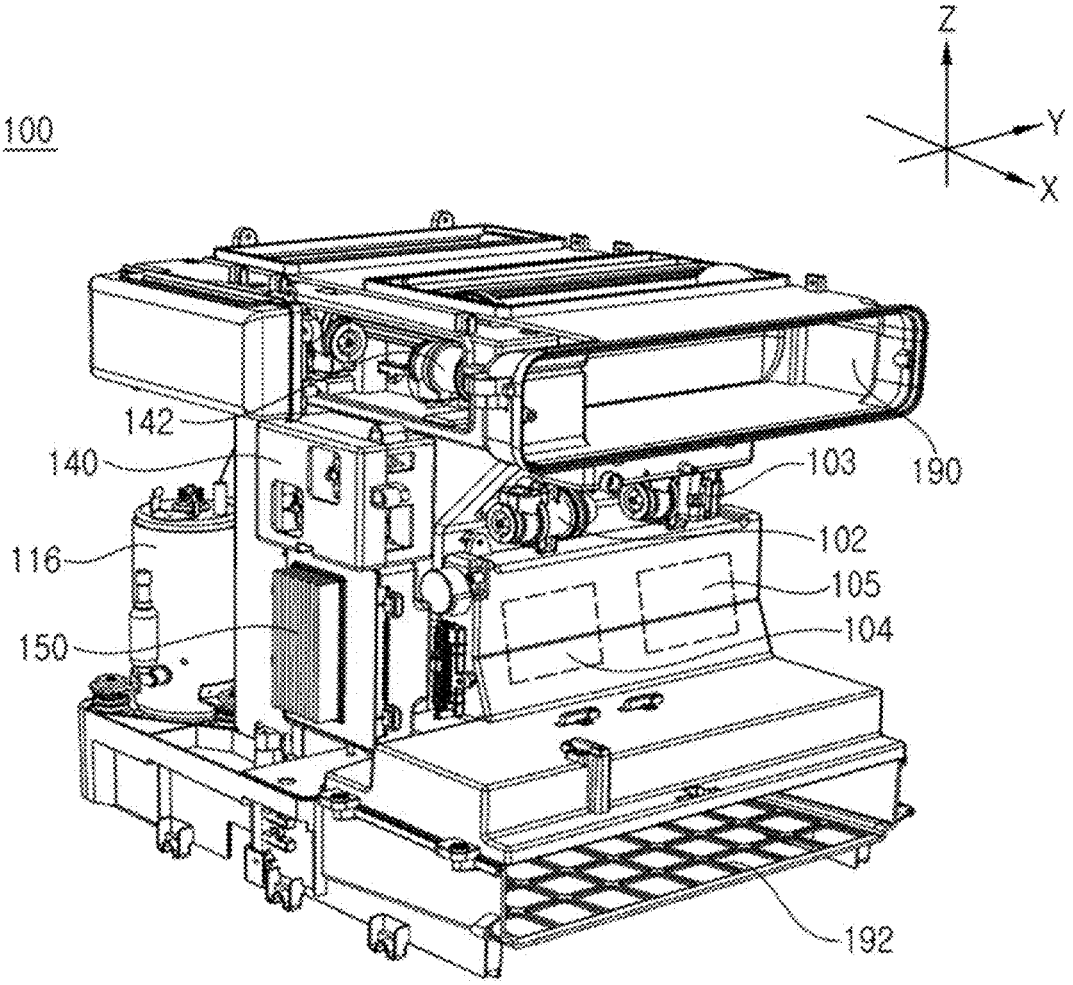
FIG. 3 is a perspective view of the machine chamber of the multifunctional storage system according to the present disclosure.

FIG. 2 is a schematic diagram of a machine chamber of the multifunctional storage system according to the present disclosure.

Referring to FIG. 2, the multifunctional storage system according to the present disclosure includes a heat pump unit 110, a humidification filter 122, and a fan unit 130.

Then, the heat pump unit 100 includes an evaporator 112, a condenser 114, a compressor 116, and a pressure controller (not illustrated).

Meanwhile, the pressure controller may be formed of an expansion control valve to adjust the pressure of a refrigerant.

Further, the pressure controller may be formed of a capillary tube instead of an expansion control valve to adjust the pressure of a refrigerant when the refrigerant passes through the pressure controller.

The compressor 116 is connected to a circuit unit 150, and includes a current measuring unit 152 configured to measure the current of the compressor 116 in the circuit unit 150.

Meanwhile, the circuit unit 150 includes a control unit 154, and the control unit 154 is configured to control the operation of a water supply pump 102 connected to a water supply tank 104 and is configured to control an operation of a moisture supply pump 126 connected to a moisture supply vessel 124.

Further, the control unit 154 is configured to also control the operation of a humidification heater unit 140 together.

Meanwhile, the humidification heater unit 140 functions to instantaneously heat water that passes through the humidification unit 140, and the water heated while passing through the humidification heater unit 140 is supplied to the humidification filter 122.

A moisture supply pump 142 is configured to pump up the water stored in the moisture supply vessel 124, and functions to circulate the water through the moisture supply vessel 124, the humidification heater unit 140, and the humidification filter 122, in the sequence thereof.

In particular, one moisture supply pump 142 may be provided, but preferably, the moisture supply pump 142 may be provided as a pair of two pumps, and may prevent generation of a disorder due to concentration of a load in a specific pump by alternately operating the pair of pumps according to a preset cycle.

The humidification filter 122 provided in the interior of the machine chamber 100 is formed to be coupled to a front end of the evaporator 112, and accordingly, the air flows through the humidification filter 122, the evaporator 112, and the condenser 114, in the sequence thereof, with reference to the direction of air circulation.

As such, since the air circulating through the machine chamber 100 or the compartment 200 passes through the humidification filter 122 before passing through the heat pump unit 110 and is thus supplied with moisture, the content of the moisture in the air passing through the heat pump unit 110 can be compensated.

Accordingly, an effect of increasing a load or condensation load of the evaporator 112 and the condenser 114 that constitute the heat pump unit 110 may be shown, and consequently, an effect of increasing the temperature of the air passing through the heat pump unit 110 is shown.

Figure 5:
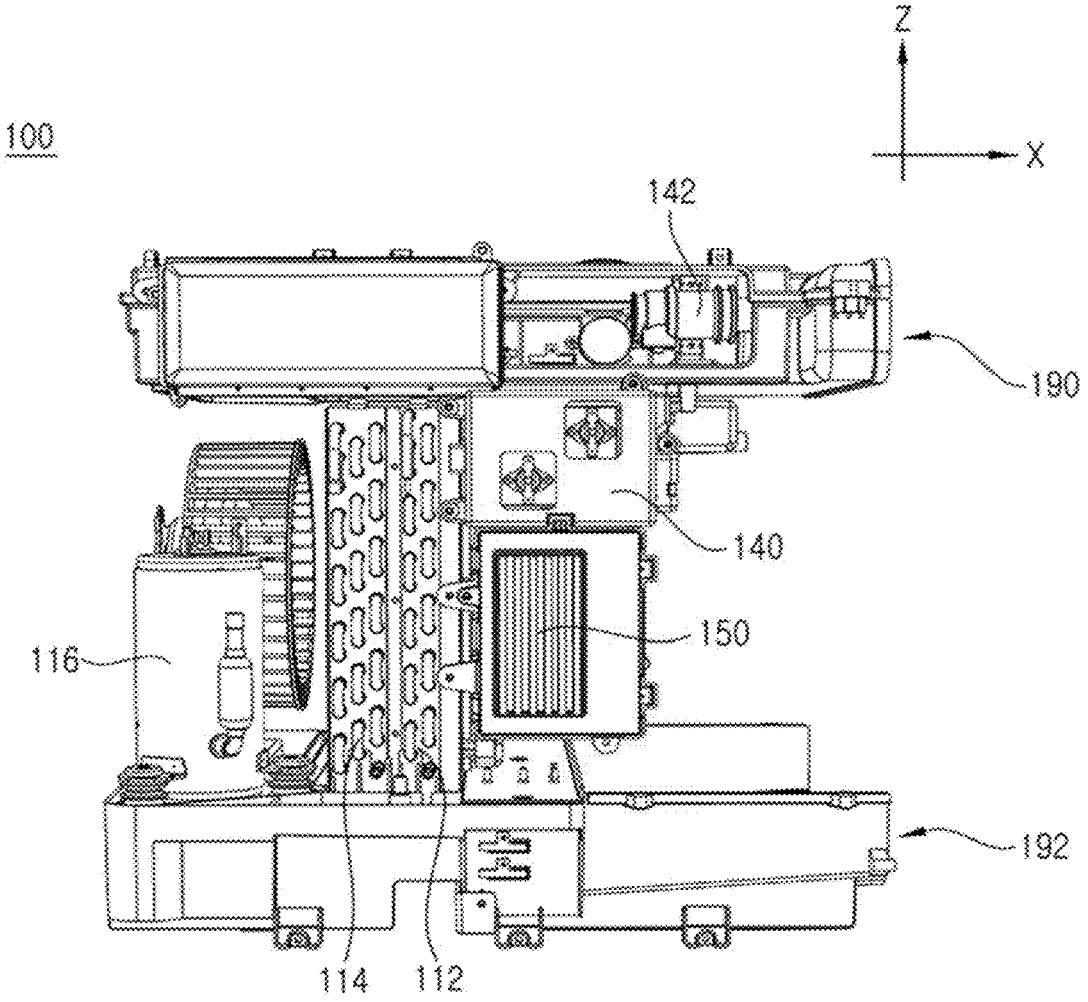
FIG. 5 is a perspective view of the machine chamber of the multifunctional storage system according to the present disclosure, viewed from the left side.

FIG. 5 is a perspective view of the machine chamber of the multifunctional storage system according to the present disclosure, viewed from the left side.

Referring to FIG. 5, the humidification heater unit 140 is disposed above the circuit unit 150. In particular, the humidification heater unit 140 may be preferably configured to heat the temperature of the water to 80° C., and an effect of increasing the temperature of the air in the machine chamber 100 is shown even only by the fact that humidification filter 122 is supplied with the moisture heated to 80° C. or a temperature close to 80° C.

Meanwhile, it is preferable that the circuit unit 150 electrically connected to the compressor 116 is formed of a printed circuit board (PCB), and a current measuring unit 152 configured to measure the value of a current flowing through the compressor 116 is provided in the circuit unit 150.

In particular, the humidification filter 122 is formed such that the moisture is supplied to the humidification filter 122 when the value of the current measured by the current measuring unit 152 is equal to or less than a preset value, while the supply of the moisture to the humidification filter 122 is stopped when the value of the current is greater than the preset value.

Further, the preset value of the current value is adjusted according to selection by a setter, and the moisture supplied to the humidification filter 122 is the water supplied in the moisture supply vessel located below the humidification filter 122.

In particular, since the moisture is not always continuously supplied to the humidification filter 122, it is preferable that the humidification filter 122 is wetted through a scheme in which water is allowed to flow into the humidification filter 122 when the moisture supply pump 126 operated by the control unit 154 is operated.

Meanwhile, if no water is initially stored in the moisture supply vessel 124, the humidification filter 122 cannot receive water from the moisture supply vessel 124.

Accordingly, until the level of the water in the moisture supply vessel 124 reaches a preset value, the water stored in the water supply tank 104 is supplied to the humidification filter 122 by the water supply pump 102.

Further, even not in the initial state, when the level of the water stored in the moisture supply vessel 124 is equal to or less than a preset value, the heated water is supplied to the humidification filter 122 after the water is supplied to the humidification heater unit 128 by operating the water supply pump 102 and is instantaneously heated.

Accordingly, the water level of the moisture supply vessel 124 may be gradually increased to a preset value, and once the water level reaches the preset value, the water in the moisture supply vessel 124 circulates and is supplied to the humidification filter 122.

Figure 6:
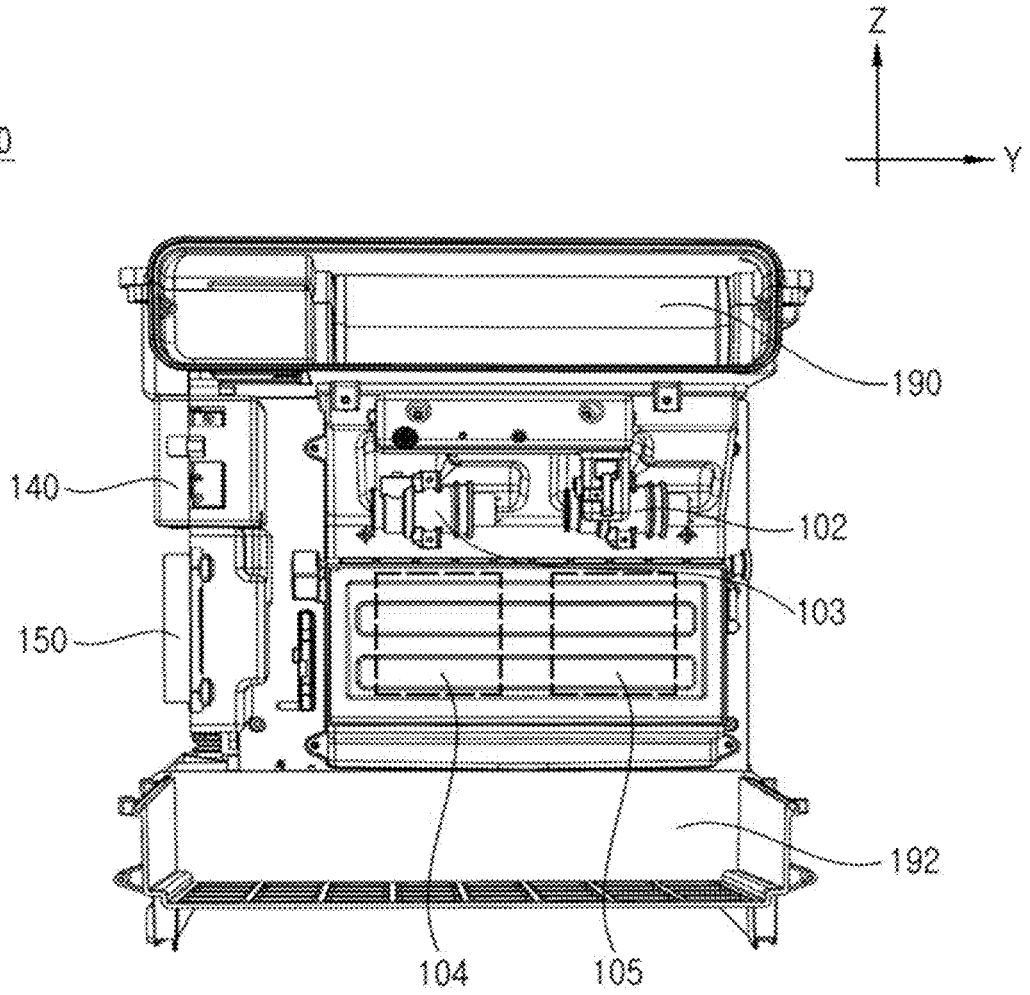
FIG. 6 is a perspective view of the machine chamber of the multifunctional storage system according to the present disclosure, viewed from the front side.

FIG. 6 is a perspective view of the machine chamber of the multifunctional storage system according to the present disclosure, viewed from the front side.

Referring to FIG. 6, a front side of the machine chamber 100 is provided with a water supply pump 102 connected to the water supply tank 104 and a water discharge pump 106 connected to a water discharge tank 105.

Meanwhile, when the water level of the water supply tank 104 is equal to or less than a preset value before the operation of the multifunctional storage system 1000, an alarm may be provided to a user such that the user supplements water, and when it is determined that the water level of the water discharge tank 105 is equal to or greater than the preset value and thus the water may overflow, an alarm may be provided to the user such that the user discards the water.

It is preferable that the operations of the above-described configurations are performed in a preheating mode to increase the operation efficiencies of a drying mode, a humidification mode, and a cleaning mode of the multifunctional storage system 1000 before these modes are performed.

Further, a designer may add a separate preheating mode to allow the user to select the preheating mode, and the preheating mode may be performed by the user before the drying mode, the humidification mode, and the cleaning mode are performed, and the preheating mode may be automatically performed according to a preset cycle.

2. Operations of First and Second Passage Switching Units in Preheating Mode of Multifunctional Storage System Referring to FIG. 4, first and second passage switching units 160 and 170 are provided between the machine chamber 100 and the compartment 200.

The first passage switching unit 160 functions to adjust the airs between the machine chamber 100 and the compartment 200 from communicating with each other or being blocked from each other.

The second passage switching unit 170 functions to allow the air in the machine chamber 100 to communicate with the outside or with the compartment 200.

In particular, it is preferable that the first and second passage switching units 160 and 170 are operated in the same way with each other, and specifically, it is preferable that when the first passage switching unit 160 is operated at a first location, the second passage switching unit 170 is also operated at the first location, whereas when the first passage switching unit 160 is operated at a second location, the second passage switching unit 170 is also operated at the second location.

Specifically, each of the first and second passage switching unit 160 and 170 includes a rotary member configured to rotate about a shaft in the interior thereof, and the rotary member is configured to be operated in a vertical or horizontal direction.

Hereinafter, a case in which the rotary members of the first and second passage switching units 160 and 170 are operated in a vertical direction will be defined as the first location, and a case in which the rotary members are operated in a horizontal direction will be defined as the second location.

Figure 4:
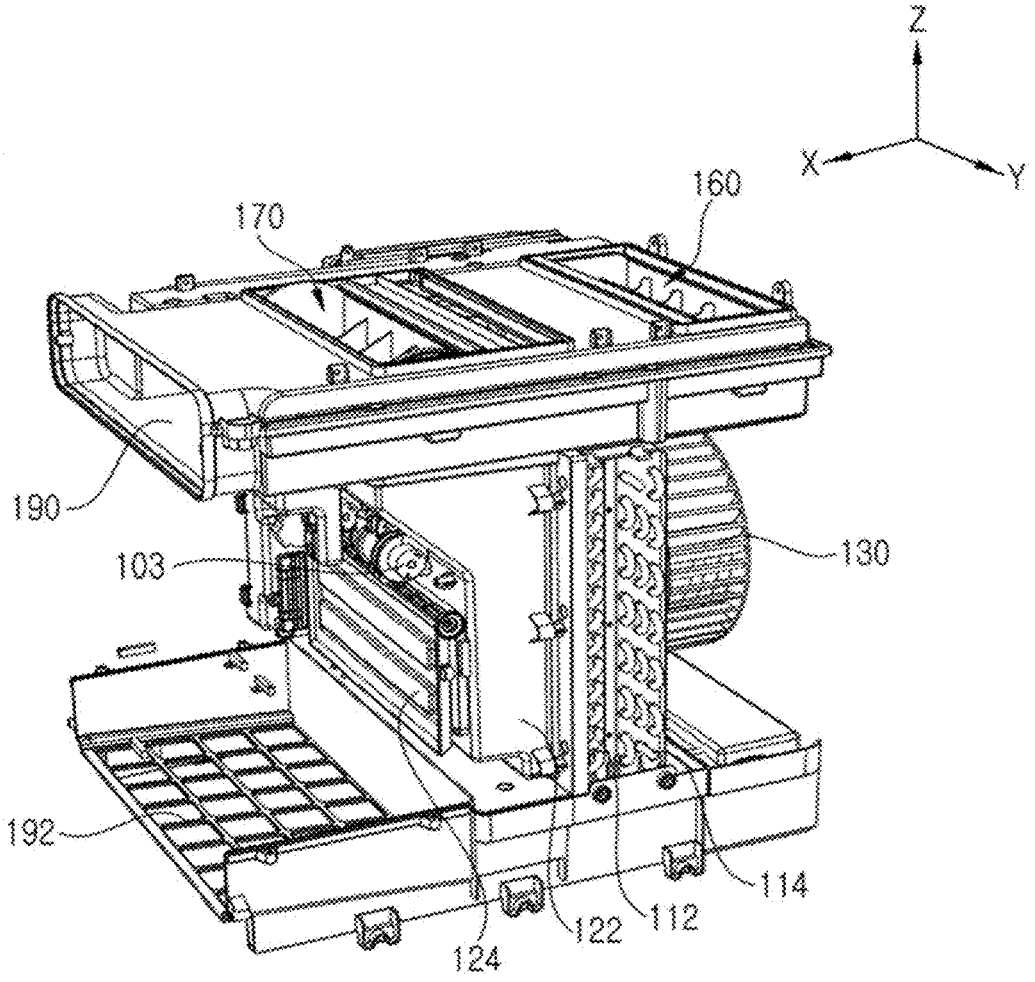
FIG. 4 is a perspective view obtained by viewing the perspective of FIG. 3 from an opposite side.

FIG. 4 illustrates a state in which both the first and second passage switching units 160 and 170 are operated at the first location.

Figure 7:
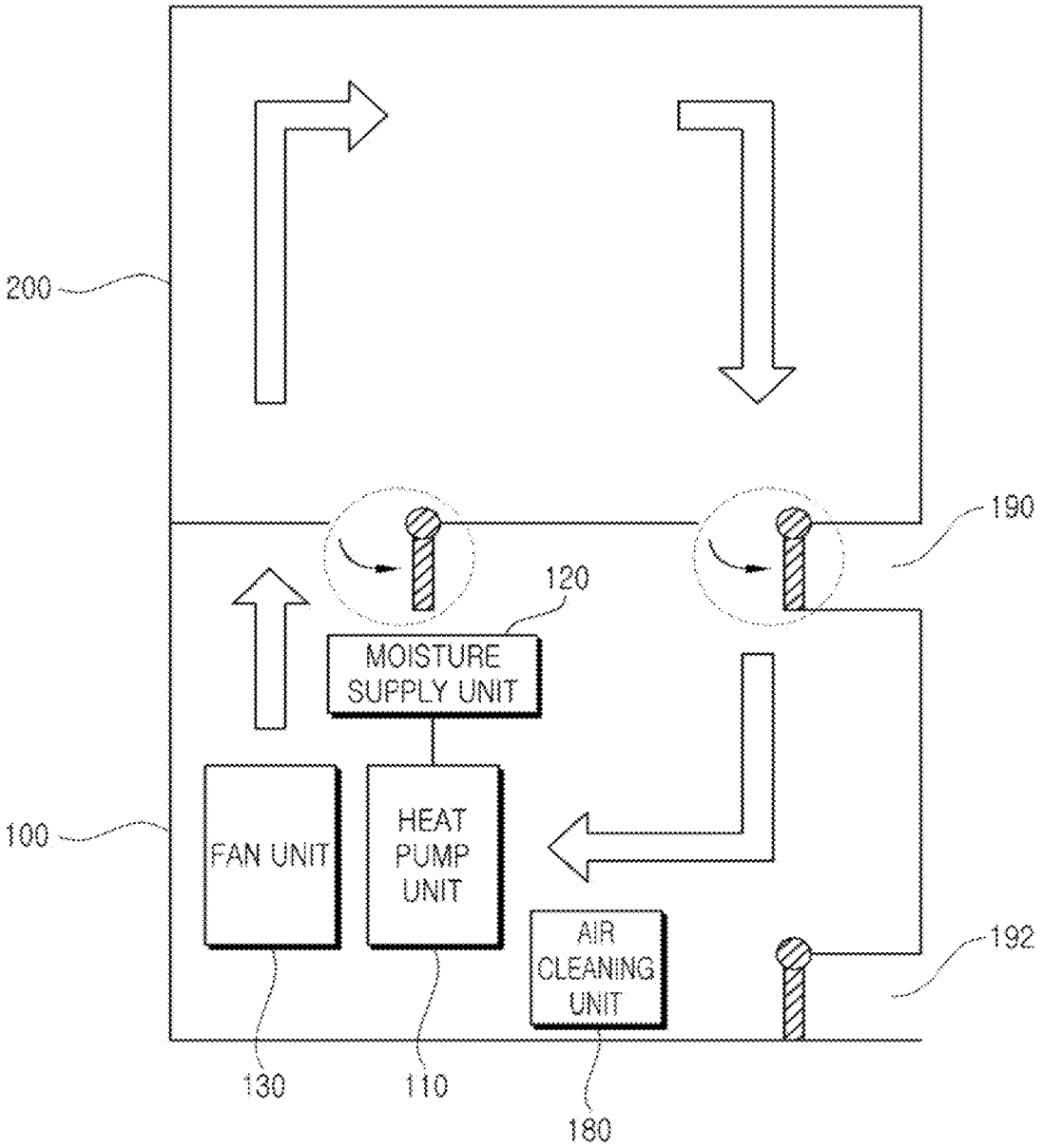
FIG. 7 is a diagram schematically illustrating circulation of air in the machine chamber and a compartment when both the first and second passage switching units of the multifunctional storage system according to the present disclosure are located at a first location.
Figure 8:
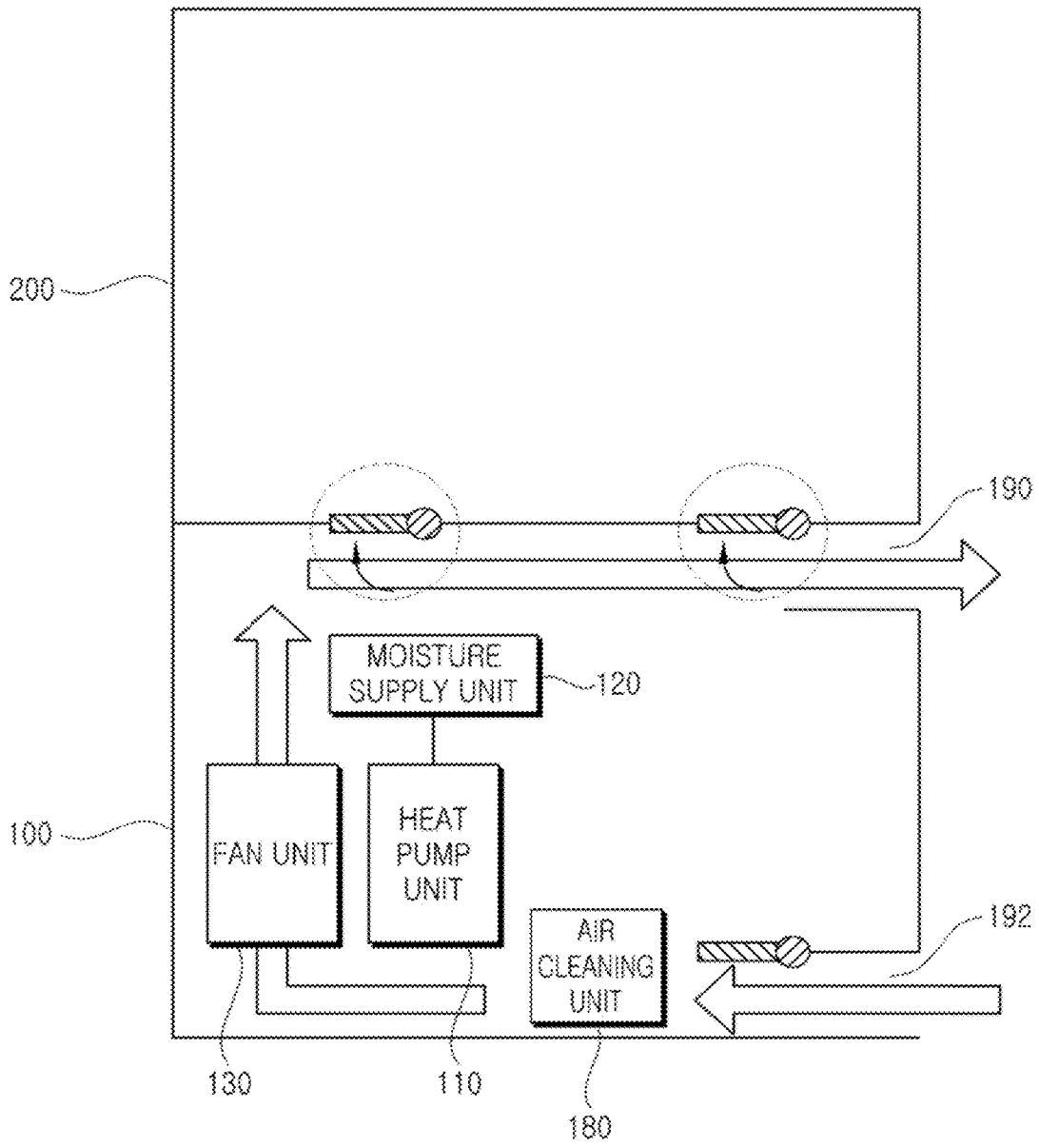
FIG. 8 is a diagram schematically illustrating circulation of air in the machine chamber and a compartment when both the first and second passage switching units of the multifunctional storage system according to the present disclosure are located at a second location.

FIG. 7 is a diagram schematically illustrating circulation of air in the machine chamber and a compartment when both the first and second passage switching units of the multifunctional storage system according to the present disclosure are located at a first location. FIG. 8 is a diagram schematically illustrating circulation of air in the machine chamber and a compartment when both the first and second passage switching units of the multifunctional storage system according to the present disclosure are located at a second location.

Referring to FIG. 7, as the first passage switching unit 160 is operated in a vertical direction, which is the first location, the airs in the compartment 200 and the machine chamber 100 communicate with each other.

Further, as the second passage switching unit 170 is also operated in a vertical direction, which is the first location, the airs in the compartment 200 and the machine chamber 100 communicate with each other, and simultaneously, the airs in the machine chamber 100 and the exterior are blocked from each other.

In particular, the airs in the machine chamber 100 and the compartment 200 communicate with each other such that the airs in the machine chamber 100 and the compartment 200 circulate together when the fan unit 130 is operated in a state in which both the first and second passage switching units 160 and 170 are operated at the first location.

Referring to FIG. 8, as the first passage switching unit 160 is operated in a horizontal direction at the second location, the air in the compartment 200 and the machine chamber 100 are blocked from each other.

Further, as the second passage switching unit 170 is also operated in a horizontal direction at the second location, the air in the compartment 200 and the machine chamber 100 are blocked from each other and the machine chamber 100 and the exterior air communicate each other.

As such, since the communication between the airs in the machine chamber 100 and the compartment 200 is interrupted in a state in which both the first and second passage switching units 160 and 170 are operated at a second location, when the fan unit 130 is operated, exterior air is discharged again to the an exhaustion duct 190 of the machine chamber 100 after being sucked into the machine chamber 100, and it is preferable that the above air flow is used in a cleaning mode.

As such, the multifunctional storage system 1000 according to the present disclosure may function to treat clothes received in the compartment 200 and simultaneously clean the air in the space, in which the multifunctional storage system 100 is located.

To achieve this, the machine chamber 100 is further provided with an air cleaning unit 180, and when the fan unit 130 is operated in a state in which both the first and second passage switching units 160 and 170 are operated at the second location, the exterior air is discharged to the exhaustion duct 190 of the machine chamber after passing through the air cleaning unit 180.

Meanwhile, in relation to the preheating mode of the multifunctional storage system 1000 according to the present disclosure, the heat pump unit 110 may be operated to preheat the machine chamber 100 in a state in which both the first and second passage switching units 160 and 170 are operated at the first location, and in particular, only the heat pump unit 110 may be operated without operating the fan unit 130.

Further, in the preheating mode, the heat pump unit 110 may be operated to preheat the machine chamber 100 in a state in which both the first and second passage switching units 160 and 170 are operated at the second location, and likewise, only the heat pump unit 110 may be operated without operating the fan unit 130.

3. Method of Preheating Multifunctional Storage System

Figure 9:
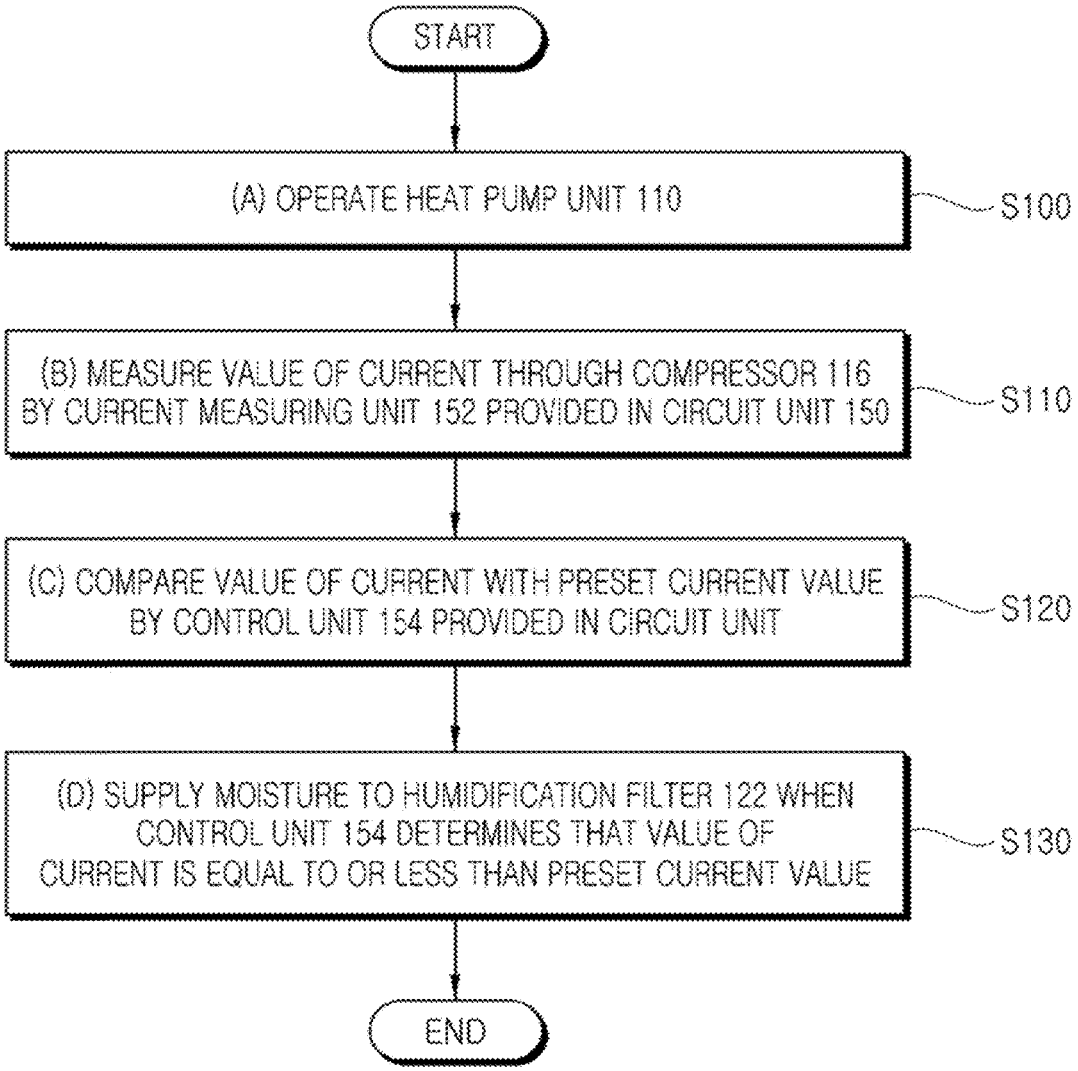
FIG. 9 is a flowchart of a method of preheating the multifunctional storage system according to the present disclosure.

FIG. 9 is a flowchart of a method of preheating the multifunctional storage system according to the present disclosure.

Referring to FIG. 9, a method of preheating the multifunctional storage system 1000 includes the steps of operating the heat pump unit 110 (S100), measuring the value of a current flowing through the compressor 116 by the current measuring unit 152 provided in the circuit unit 150 (S110), comparing the value of the current with a preset current value by the control unit 154 provided in the circuit unit 150 (S120), and supplying moisture to the humidification filter 122 when the control unit (154) determines that the value of the current is equal to or less than the preset current value (S130).

As described above, since air can naturally circulate as it is heated by the heat pump unit 110 without additionally operating the fan unit 130 that circulates the air in the machine chamber 100 or the compartment 200, consumption of electric power used in the preheating mode can be minimized.

In particular, before step S100, a step (S90) of operating both the first and second passage switching units 160 and 170 at the first location may be further included.

Further, before step S100, a step (S90) of operating both the first and second passage switching units 160 and 170 at the second location may be further included.

Meanwhile, a separate member that opens and closes the intake duct may be further included, and accordingly, since the preheating mode is performed after the intake duct is closed in a state in which the fan unit 130 is not operated, the preheating efficiency can be maximized.

Although the embodiments illustrated in the drawings have been described in the specification for reference such that a person skilled in the art can easily understand and realize the present disclosure, they are merely exemplary and a person skilled in the art can understand that various modifications and equivalent embodiments can also be made from the embodiments of the present disclosure. Accordingly, the scope of the present disclosure must be determined by the claims.

DESCRIPTION OF REFERENCE NUMERALS

1000: multifunctional storage system
100: machine chamber
200: compartment
110: heat pump unit
112: evaporator
114: condenser
116: compressor
118: pressure controller
120: moisture supply unit
122: humidification filter
124: moisture supply vessel
130: fan unit
140: humidification heater unit
142: moisture supply pump
144: moisture supply tank
150: circuit unit
152: current measuring unit
160: first passage switching unit
170: second passage switching unit
180: air cleaning unit

The invention claimed is:

1. A multifunctional storage system comprising a machine chamber and a compartment, in which clothes are received, the multifunctional storage system comprising:

a heat pump unit located in the machine chamber and comprising an evaporator, a condenser, a compressor, and a pressure controller;

a moisture supply unit coupled to the heat pump unit and comprising a humidification filter: and a fan unit configured to circulate air in the machine chamber from the evaporator toward the condenser, wherein the moisture supply unit is coupled to a front end of the evaporator with reference to a circulation direction of the air, and wherein moisture is supplied to the humidification filter according to a preset condition, and loads of the evaporator and the condenser are increased as the moisture is supplied to the air when the air passes through the humidification filter.

2. The multifunctional storage system of claim 1, wherein the moisture supply unit comprises:

a moisture supply vessel provided below the humidification filter and configured to store water flowing out of the humidification filter; and wherein the multifunctional storage system further comprises a moisture supply pump connected to the moisture supply vessel and configured to pump up the water in the moisture supply vessel, and wherein the humidification filter is configured to allow the water stored in the moisture supply vessel to be supplied by the moisture supply pump.

3. The multifunctional storage system of claim 2, wherein the moisture supply unit further comprises a humidification heater unit connected to the moisture supply pump, configured to receive water from the moisture supply vessel, and configured to heat the temperature of the water to a preset temperature, and the moisture supply pump is configured to supply the water heated to the preset temperature by the humidification heater unit to the humidification filter.

4. The multifunctional storage system of claim 2, further comprising:

a water supply tank configured to store water and connected to the water supply pump, wherein a water supply pump is operated to supply moisture to the humidification filter when the level of water in the moisture supply vessel of the moisture supply unit is equal to or less than a preset value.

5. The multifunctional storage system of claim 4, wherein the water supply tank is connected to the humidification heater unit and wherein the water stored in the water supply tank is heated while passing through the humidification heater unit and is then supplied to the humidification filter when the water supply pump is operated.

6. The multifunctional storage system of claim 1, wherein a circuit unit is electrically coupled to the compressor, wherein the circuit unit comprises a current measuring unit configured to measure the value of a current flowing through the compressor, and wherein moisture is supplied to the humidification filter when the value of the current measured by the current measuring unit is equal to or less than a preset value, and the supply of moisture to the humidification filter is stopped when the value of the current is greater than the preset value.

7. The multifunctional storage system of claim 1, wherein the machine chamber is located below the compartment, wherein first and second passage switching units are provided between the machine chamber and the compartment, wherein the airs in the machine chamber and the compartment communicate with each other such that they circulate together when the fan unit is operated in a state in which both the first and second passage switching units are operated at a first location, and wherein the communication between the airs in the machine chamber and the compartment is blocked in a state in which both the first and second passage switching units are operated at a second location, and when the fan unit is operated, exterior air is discharged again to an exhaustion duct of the machine chamber after being sucked into the machine chamber.

8. The multifunctional storage system of claim 7, wherein the machine chamber further comprises an air cleaning unit, and wherein when the fan unit is operated in a state in which both the first and second passage switching units are operated at the second location, the exterior air is discharged to the discharge duct of the machine chamber after passing through the air cleaning unit.

9. The multifunctional storage system of claim 7, wherein in a state in which both the first and second passage switching units are operated at the first location, the heat pump unit is operated to preheat the machine chamber.

10. The multifunctional storage system of claim 7, wherein in a state in which both the first and second passage switching units are operated at the second location, the heat pump unit is operated to preheat the machine chamber.

11. The multifunctional storage system of claim 1, wherein the pressure controller is a capillary, tube.

12. The multifunctional storage system of claim 1, wherein the pressure controller is an expansion control valve.

13. A method of preheating the multifunctional storage system of claim 1, by using the multifunctional storage system, the method comprising:

(a) operating the heat pump unit;

(b) measuring the value of a current flowing through the compressor by a current measuring unit provided in a circuit unit;

(c) comparing the value of the current with a preset current value by a control unit provided in the circuit unit; and (d) supplying moisture to the humidification filter when the control unit determines that the value of the current is equal to or less than a preset current value.

14. The method of claim 13, further comprising:

before step (a), (a-0) operating both first and second passage switching units at a first location.

15. The method of claim 14, further comprising:

before step (a), (a-1) operating both first and second passage switching units at a second location.

* * * * *